US005918454A

United States Patent [19]

Tanaka et al.

[11] Patent Number: 5,918,454

[45] Date of Patent: Jul. 6, 1999

[54] SPINNING RING STRUCTURE WITH AN AERODYNAMIC BRAKE MEMBER

[75] Inventors: Yutaka Tanaka, Gifu; Hiroshi Enomoto; Hideyuki Goto, both of Aichi-ken; Yasushi Iwama, Iwakura, all of Japan

[73] Assignees: Nippo Ltd., Osaka-fu, Japan; Howa Machinery, Ltd., Aichi-ken, Japan

[21] Appl. No.: 08/886,781

[22] Filed: Jul. 1, 1997

[30] Foreign Application Priority Data

Jul. 4, 1996 [JP] Japan ..... 8-174519

[51] Int. Cl.[6] ..... D01H 7/64

[52] U.S. Cl. ..... 57/124; 57/75; 57/78

[58] Field of Search ..... 57/75, 78, 119, 57/124, 136, 137

[56] References Cited

U.S. PATENT DOCUMENTS 5,010,722 4/1991 Yamaguchi et al. ..... 57/124
5,148,662 9/1992 Yamaguchi ..... 57/124

FOREIGN PATENT DOCUMENTS 0 730 054 A1 9/1996 European Pat. Off. .
62-299522 12/1987 Japan ..... 57/124
WO9608592 3/1996 WIPO .

*Primary Examiner*—William Stryjewski
*Attorney, Agent, or Firm*—Ladas & Parry

[57] ABSTRACT

A spinning ring structure (10) for twisting a fleece into a yarn and taking up the yarn on a bobbin (82) comprises a stationary ring (20) fixedly mounted on a ring rail (74), a rotary ring (30) disposed for rotation about its own axis inside the stationary ring (20) coaxially therewith so as to surround the bobbin (82) disposed with the stationary ring (30). A traveler (50) is put on the rotary ring (30) so as to revolve along the circumference of the rotary ring, and a brake ring (60) is mounted on the rotary ring (30) and provided with a plurality of radial vanes (68) to which air applies resistance against the turning of the brake ring. The brake ring (60) is provided with an air pressure evading wall (64) for avoiding the influence of a pressure generated by whirling air currents produced by the rotating cop, on the brake ring (60) to prevent retardation of the variation of the rotational speed of the rotary ring according to the variation of the effective circumferential speed of the cop built on the bobbin during a cop building operation so that a balloon formed by the yarn will not expand and will not collapse.

20 Claims, 7 Drawing Sheets

SPINNING RING STRUCTURE WITH AN AERODYNAMIC BRAKE MEMBER

BACKGROUND OF THE INVENTION

1. Field of the Invention

The present invention relates to a spinning ring structure for winding a yarn delivered from a yarn delivery unit on a bobbin.

2. Description of the Related Art

A spinning frame employing spinning ring structures of the foregoing kind, and a conventional spinning ring structure will be described. Referring to FIG. 1, a plurality of roving packages 70 are supported on package support bars extending perpendicularly to the sheet of the drawing in an upper portion of a spinning frame. A plurality of drafting units 72 are arranged in rows perpendicular to the sheet of the drawing under the roving packages 70 on the right and the left side of the spinning frame substantially at the middle of the height of the spinning frame. Ring rails 74 are extended perpendicularly to the sheet of the drawing as shown in FIG. 4. The ring rails 74 are supported for vertical reciprocation on vertical ring rail lifting pillars 78 which are driven for vertical movement by a motor, not shown. A plurality of mounting holes 75 (FIG. 4) are formed in a longitudinal arrangement in each ring rail 74 and spinning ring structures 110 are fitted in the mounting holes 75, respectively. Referring again to FIG. 1, a plurality of yarn guides 76 each having a guide hole 77 are supported on vertically movable yarn guide lifting pillars 79 so as to correspond to the spinning ring structures 110, respectively. Separators 95 are disposed between adjacent spinning ring structures 110, respectively, as shown in FIG. 7.

A spindle 80 is supported for spinning so as to extend through and coaxially with the spinning ring structure 10. The spindle 80 is driven for spinning by a motor, not shown. A bobbin 82, not shown in FIG. 1, is put on the spindle 80 and is restrained from turning relative to the spindle 80.

FIG. 14 shows a spinning ring structure 110 as disclosed in, for example, International Publication No. WO96/08592. This prior art spinning ring structure 110 has a stationary ring 20, a rotary ring 30 disposed inside and supported for rotation on the stationary ring 20 and having a flange 32 at its upper end, and a traveler 50 put on the flange 32 of the rotary ring 30 for sliding along the flange 32. A brake ring 160 is disposed under the rotary ring 30. The brake ring 160 is provided on its lower surface with a plurality of radial vanes 168 as shown in FIG. 15.

A roving $T_1$ unwound from the roving package 70 is drafted by the drafting unit 72 into a fleece, the fleece is twisted into a yarn $T_2$ as the same advances through the guide hole 77 of the yarn guide 76 and the traveler 50 put on the flange 32 of the rotary ring 30 toward the bobbin 82, and the yarn $T_2$ is taken up on the bobbin 82 by the agencies of the rotating bobbin 82 (spindle 80), the revolving traveler 50 and the rotation of the rotary ring 30 as the spinning ring structure 110 is vertically reciprocated together with the ring rail 74.

Since the traveler 50 is pressed strongly against the rotary ring 30 by a centrifugal force, the rotary ring 30 always rotates together with the traveler 50 excluding an initial period subsequent to the start of the spinning frame. The brake ring 160 brakes the rotating rotary ring 30 properly to restrain the rotary ring from rotation at an excessively high rotating speed.

A yarn winding speed at which the yarn T2 is taken up on the bobbin 82 is equal to a value obtained by subtracting the traveling speed of the traveler 50 on the flange 32 of the rotary ring 30 from the effective circumferential speed of the cop, i.e., the circumferential speed of a portion of a cop built by winding the yarn $T_2$ on the bobbin 82, in a plane including the yarn T2 being taken up on the bobbin 82. The roving $T_1$ is fed from the roving 70 at a fixed feed speed. A yarn winding speed at which the yarn $T_2$ is taken up on the bobbin 82 must be equal to a fleece delivery speed at which the drafting unit 72 delivers the fleece. However, while the spinning ring structure 110 is reciprocated for a cop building operation between a height A and a height B as shown in FIG. 5 and the yarn $T_2$ is being taken up on the bobbin 82, the diameter $d_2$ of a portion of the cop corresponding to the height B is large, and the diameter $d_1$ of a portion of the cop corresponding to the height A is small. Since the angular velocity $\omega_0$. of the spindle 80, hence that of the bobbin 82, is constant, the circumferential speed $v_2=d_2\omega_0/2$ of the portion of the cop corresponding to the height B is higher than the circumferential speed $v_1=d_1\omega_0/2$ of the portion of the cop corresponding to the height A. Accordingly, the traveling speed of the traveler 50, hence the rotating speed of the rotary ring 30, must vary according to the variation of the effective circumferential speed of the cop built on the bobbin 82 as indicated by a curve in FIG. 6 for an ideal mode. However, when the conventional spinning ring 110 is used, the deceleration of the traveling speed of the traveler 50 (the rotational speed of the rotary ring 30) is retarded as indicated by alternate long and two short dashes lines in FIG. 6 in an initial period of upward movement of the spinning ring unit 110 from the height B toward the height A and the actual traveling speed of the traveler 50 exceeds the ideal traveling speed. Consequently, a balloon formed by the yarn $T_2$ between the guide hole 77 of the yarn guide 76 and the traveler 50 expands or ballooning occurs, and the yarn touches the separator 95 and, in the worst case, breaks, so that the balloon collapses. In FIG. 7, a normal balloon is indicated by alternate long and short dash lines and an expanded balloon is indicated by alternate long and two short dashes lines.

It is inferred from the results of experimental spinning operation that the deceleration of the traveling speed of the traveler 50 is retarded because whirling air currents produced between the cop and the rotary ring 30 by the rotating cop act on the vanes 168 of the brake ring 160 to urge the decelerating rotary ring 30 in its rotating direction.

SUMMARY OF THE INVENTION

Accordingly, it is an object of the present invention to provide a spinning ring structure including a rotary ring which can properly be decelerated when the same needs deceleration so that the collapse of a balloon of a yarn can be avoided.

According to the present invention, a spinning ring structure for twisting a fleece produced by drafting a roving supplied from a roving feed means into a yarn and taking up the yarn on a bobbin comprises: a stationary ring fixedly mounted on a ring rail; a rotary ring disposed for rotation about its own axis inside the stationary ring coaxially therewith so as to surround the bobbin coaxially with the stationary ring; a traveler put on the rotary ring so as to be able to revolve along the circumference of the rotary ring to guide the yarn toward a cop formed by winding the yarn on the bobbin; and a brake member mounted on the rotary ring and provided with means for producing resistance against the turning of the brake member. The spinning ring structure is provided with an air pressure evading wall for preventing a pressure generated by whirling air currents produced by the rotating cop from influencing a braking motion of the brake member.

The yarn being guided toward and wound on the cop formed on the bobbin causes the traveler to revolve on the rotary ring as the bobbin rotates and the revolving traveler drags the rotary ring so that the rotary ring rotates. The brake member exerts a braking force on the rotary ring in order that the rotary ring may not rotate at an excessively high rotating speed. Since there is provided the air pressure evading wall, the undesirable acceleration of the brake member, hence the undesirable acceleration of the rotary ring, by the whirling currents produced by the rotating cop, can be avoided. Consequently, the rotary ring is able to be decelerated according to the decrease of the effective circumferential speed of the cop, i.e., the circumferential speed of a portion of the cop on which the yarn is being wound, varying with the height of the spinning ring structure. Therefore, the collapse of a balloon formed by the yarn can be avoided and a satisfactory spinning operation can be achieved.

In the spinning ring structure according to the present invention, the brake member may be a brake ring combined coaxially with the rotary ring and provided with a plurality of radial vanes, and the air pressure evading wall screens at least portions of the radial vanes from the whirling air currents on the side of the cop. The air pressure evading wall may screen the radial vanes entirely or partly from the whirling air currents on the side of the cop. The radial vanes includes vanes extending radially of the brake member and those extending substantially radially of the brake member.

In the spinning ring structure according to the present invention, the vanes may be those not exposed to a space around an upper portion of the spinning ring structure. The vanes not exposed to the space around the upper portion of the spinning ring structure are desirable in view of safety for the operator.

In the spinning ring structure according to the present invention, the vanes may substantially be screened from the ambience. Since the vanes of the brake ring are not exposed to the frictional resistance of air when the brake ring rotates together with the rotary ring, the braking effect of the brake ring does not increase progressively with the increase of its rotating speed and hence excessively high braking force is not generated and, consequently, load on a driving system for driving the cop for rotation is not increased excessively and the driving system does not require high energy.

In the spinning ring structure according to the present invention, the plurality of vanes are formed under the rotary ring, the lower ends of the plurality of vanes may be covered with a lower screening wall, and an imaginary cylindrical surface including the outer edges of the plurality of vanes is close to the stationary ring. The lower screening wall may be joined to the lower ends of the plurality of vanes and may rotate together with the plurality of vanes or may be fixedly disposed under the plurality of vanes. The effect of suppressing the excessive increase of load on the driving system for driving the cop and suppressing the energy requirement of the driving system can be enhanced by this arrangement, because the lower ends of the plurality of vanes are covered with the lower screening wall and the outer ends of the radial vanes are close to the stationary ring and substantially isolated from the ambient air.

In the spinning ring structure according to the present invention, a gap terminating at a portion of a member with which the rotary ring is in sliding contact may be formed between the stationary ring and the brake ring so as to open into a circumferential space around the spinning ring structure. If the gap is thus opens into a circumferential space around the spinning ring structure, radial air currents produced by the rotating brake ring flow to the outside through the gap to dissipate effectively heat generated by friction between the rotary ring and the member with which the rotary ring is in sliding contact when the rotary ring rotates. Accordingly, the rotary cylinder may not be caused to expand by the heat to increase frictional resistance against its rotation and hence the rotary ring is able to rotate smoothly for a smooth spinning operation.

The above and other objects, features and advantages of the present invention will become more apparent from the following description taken in connection with the accompanying drawings.

DESCRIPTION OF THE PREFERRED EMBODIMENTS

Figure 1:
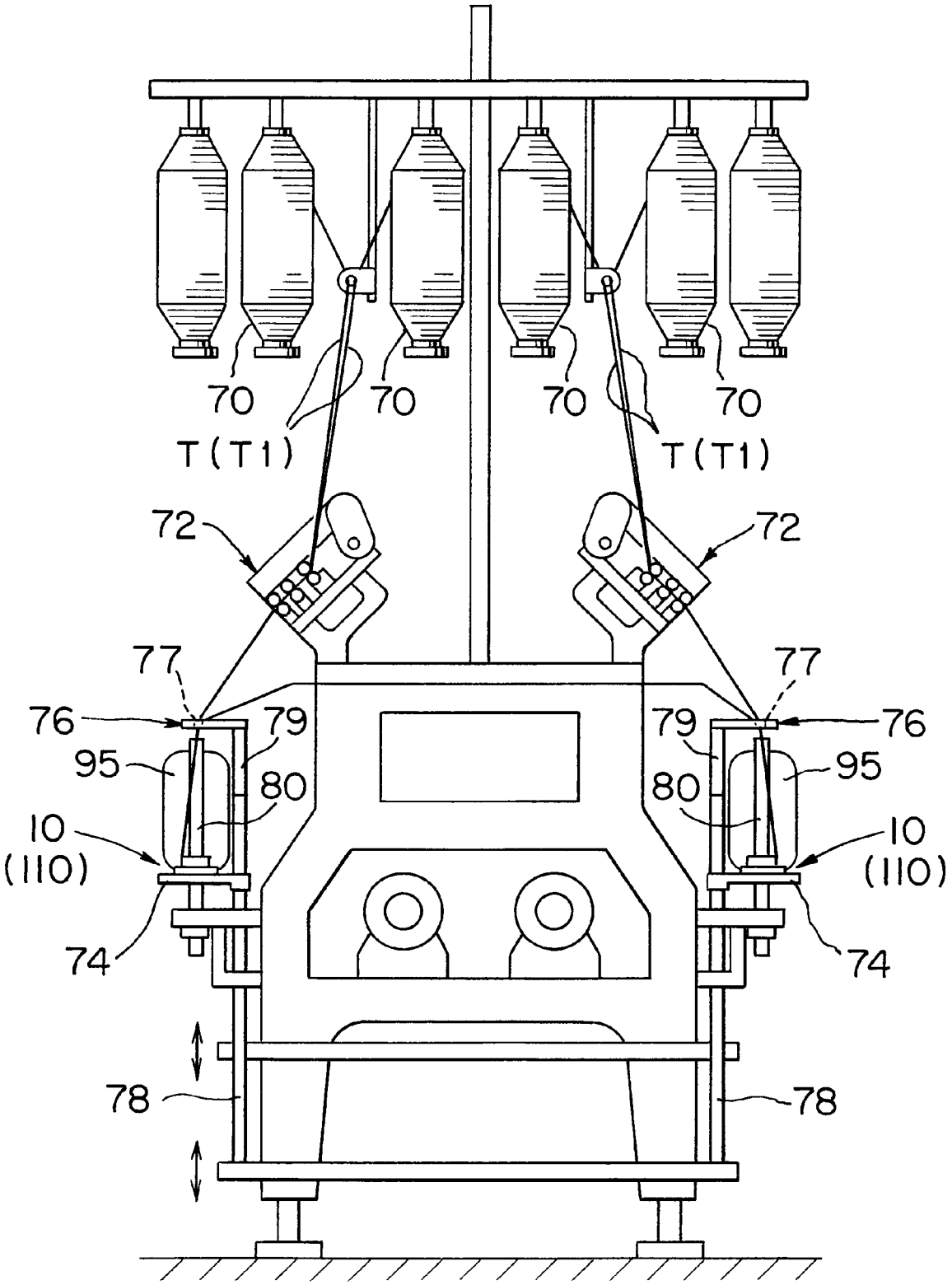
FIG. 1 is a general end view of a spinning frame that can use conventional spinning ring structures or spinning ring structures in accordance with the present invention.

Spinning ring structures in accordance with the present invention are used on a spinning frame as previously described with reference to FIG. 1.

First Embodiment

Figure 2:
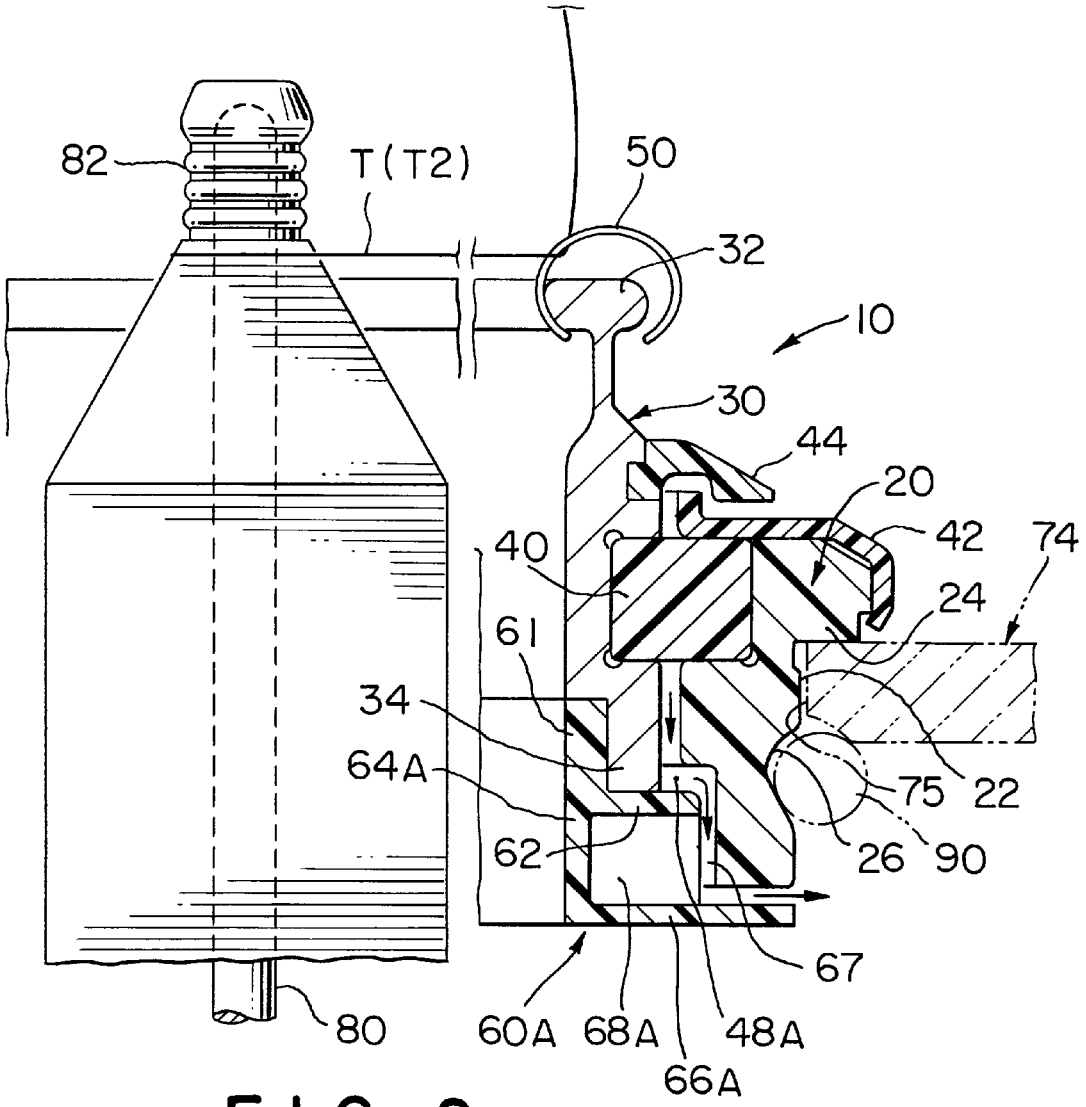
FIG. 2 is an enlarged fragmentary longitudinal sectional view of a spinning ring structure in a first embodiment according to the present invention.

Referring to FIG. 2, a spinning ring structure 10 according to a first embodiment of the present invention comprises a stationary ring 20 made of a synthetic resin, a rotary ring 30, a sliding ring 40, a traveler 50 and a brake ring 60A made of a synthetic resin. The stationary ring 20 has a fitting portion 22 having a cylindrical outer circumference provided with a groove 26 for receiving a rubber retaining ring 90, and an annular flange 24. The fitting portion 22 of the stationary ring 20 is fitted in a mounting hole 75 of a ring rail 74 with the flange 24 seated on the surface of the ring rail 74, and then the rubber retaining ring 90 is fitted in the groove 26 to hold the stationary ring 20 in place on the ring rail 74. The rotary ring 30 is disposed inside the stationary ring 20 coaxially with the stationary ring 20 and is supported for rotation about its axis. The sliding ring 40 is made of an engineering plastic and interposed between the stationary ring 20 and the rotary ring 30 to enable the rotary ring 30 to rotate smoothly relative to the stationary ring 20. The sliding ring 40 is retained in place by a retaining cover 42 fixedly put on the stationary ring 20. An annular dustproof cover 44 is attached to an upper portion of the rotary ring 30 to exclude dust from gaps between the stationary ring 20 and the rotary ring 30. The rotary ring 30 is provided at its upper end with an annular flange 32. The traveler 50 is put on the flange 32 of the rotary ring 30 for circumferential revolution along the flange 32.

Figure 3:
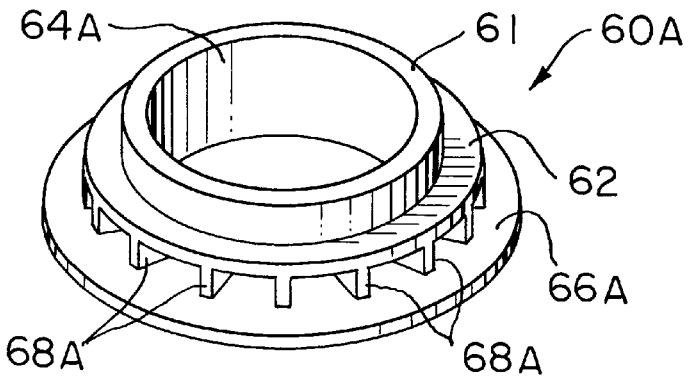
FIG. 3 is a perspective view of a brake ring included in the spinning ring structure of FIG. 2.
Figure 4:
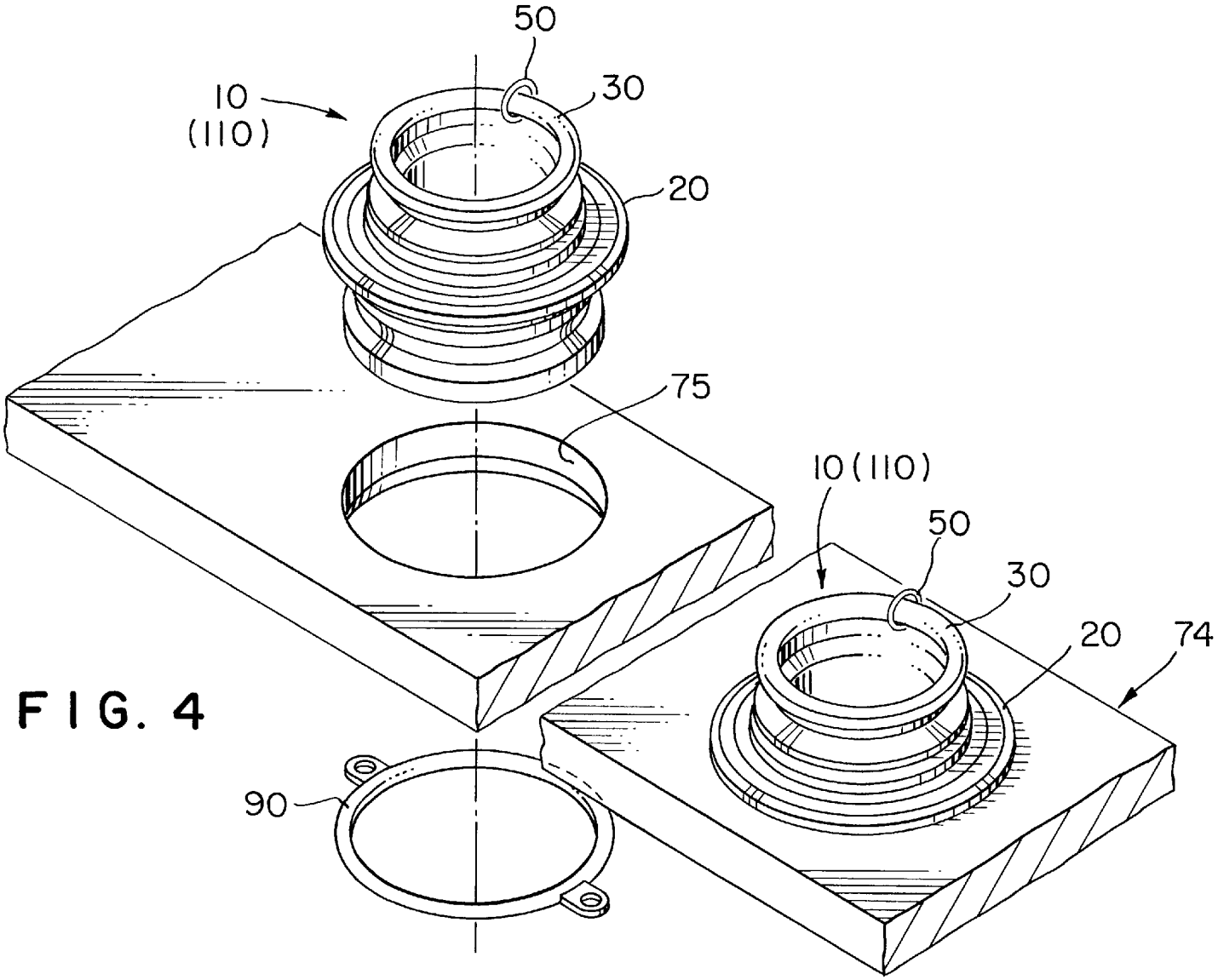
FIG. 4 is a fragmentary perspective view of a ring rail for supporting either the conventional spinning ring structure or the spinning ring structure of the present invention shown in FIG. 2.

As shown in FIGS. 2 and 3, the brake ring 60A has an annular fitting portion 61 at its upper end, a flange 62 formed at the lower end of the annular fitting portion 61, a plurality of radial vanes 68A formed on the lower surface of the flange 62 at equal angular intervals, an annular screening flange 66A contiguous with the lower edges of the radial vanes 68A, and a cylindrical air pressure evading wall 64A formed integrally with the inner edges, i.e., the edges on the side of a bobbin 82 put on a spindle 80, of the radial vanes 68A. The screening flange 66A extends radially outward from the lower end of the air pressure evading wall 64A and underlies the lower end of the stationary ring 20.

As shown in FIG. 2, the fitting portion 61 of the brake ring 60A is fixedly fitted in a skirt 34 formed in a lower end portion of the rotary ring 30 with the flange 62 thereof pressed against the lower end of the skirt 34. A narrow gap 67 is formed between the outer edge of each radial vane 68A and the inner circumference of the stationary ring 20. The air pressure evading wall 64A isolates the radial vanes 68A from a space around a cop formed by winding a yarn on the bobbin 82. The radial vanes 68A are surrounded by the flange 62, the air pressure evading wall 64A, the lower screening flange 66A and the stationary ring 20 so as to be isolated from the space around the spinning ring structure 10. A gap 48A is formed between the stationary ring 20 and the combination of the rotary ring 30 and the brake ring 60A. The gap 48A terminates at the sliding ring 40 and opens into a circumferential space around the spinning ring structure 10.

The stationary ring 20, the rotary ring 30, the sliding ring 40, the traveler 50 and the brake ring 60A of the spinning ring structure 10 are designed so that the sum of a frictional resistance of the sliding ring 40 against the rotation of the rotary ring 30 and a resistance of air against the rotation of the brake ring 60A makes the rotary ring 30 rotate together with the traveler 50 when the bobbin 82 is rotating in a steady state (not necessarily immediately after the rotation of the bobbin 82 has become a steady state) at a high rotational speed in the range of 10,000 to 15,000 rpm.

As mentioned above with reference to FIG. 1, the ring rail 74 is reciprocated vertically to reciprocate the spinning ring structure 10 vertically, and the spindle 80 supporting the bobbin 82 spins. The traveler 50 is dragged for revolution along the flange 32 of the rotary ring 30 by a yarn $T_2$ being wound on the bobbin 82, and the rotary ring 30 is rotated by a frictional dragging force exerted thereon by the traveler 50. The drafting unit 72 drafts a roving $T_1$ into a fleece and delivers the fleece at a predetermined delivery speed, the fleece is twisted into a yarn $T_2$, the yarn $T_2$ travels through the guide hole 77 of the yarn guide 76 and through the traveler 50 of the spinning ring structure 10 and is taken up on the bobbin 82. When the spindle 80 supporting the bobbin 82 starts rotating, the traveler 50 starts revolving along the flange 32 of the rotary ring 30, and the rotary ring 30 is dragged for rotation by the frictional dragging force of the traveler 50. The traveler 50 is pressed strongly against the rotary ring 30 by a high centrifugal force acting thereon when the spindle 80 supporting the bobbin 82 spins in a steady state, i.e., at a fixed angular velocity $\omega_0$, at a high rotational speed in the range of 10,000 to 15,000 rpm, so that the rotary ring 30 rotates substantially together with the traveler 50.

Figure 5:
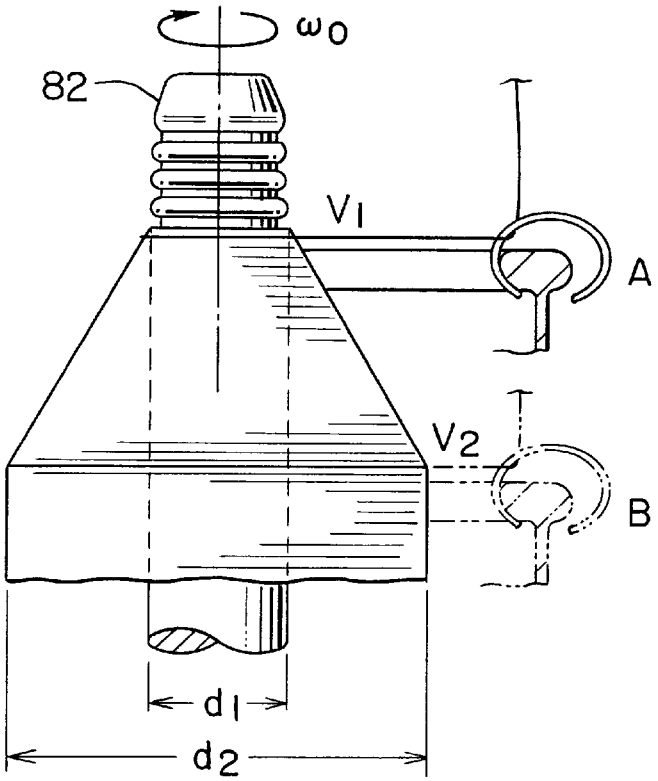
FIG. 5 is a fragmentary front view of a cop, for assistance in explaining a dynamic mechanism of a cop building operation for taking up a yarn on a bobbin to build a cop.
Figure 6:
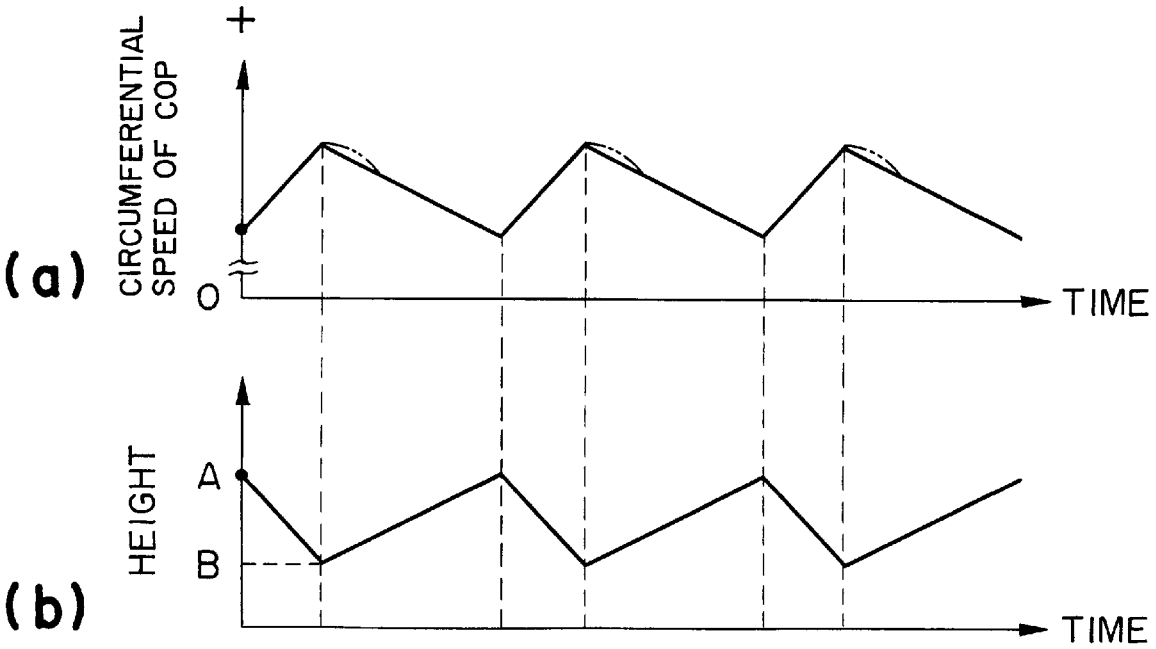
FIG. 6 is a diagram for assistance in explaining the relation between the vertical position of a traveler and the traveling speed of the same.

As mentioned previously with reference to FIGS. 5 and 6, while the spinning ring structure 10 is reciprocated vertically for a cop building operation between the height A and the height B as shown in FIG. 5 and the yarn $T_2$ is being taken up on the bobbin 82, the diameter $d_2$ of a portion of a cop corresponding to the height B is large, and the diameter di of a portion of the cop corresponding to the height A is small. Since the angular velocity $\omega_0$ of the spindle 80, hence that of the bobbin 82, is constant, the circumferential speed $v_2=d_2\omega_0/2$ of the portion of the cop corresponding to the height B is higher than the circumferential speed $v_1=d_1\omega_0/2$ of the portion of the cop corresponding to the height A. Accordingly, the traveling speed of the traveler 50, hence the rotational speed of the rotary ring 30, must vary according to the variation of the effective circumferential speed of the cop built on the bobbin 82 as indicated by a curve in FIG. 6 for an ideal mode.

Figure 7:
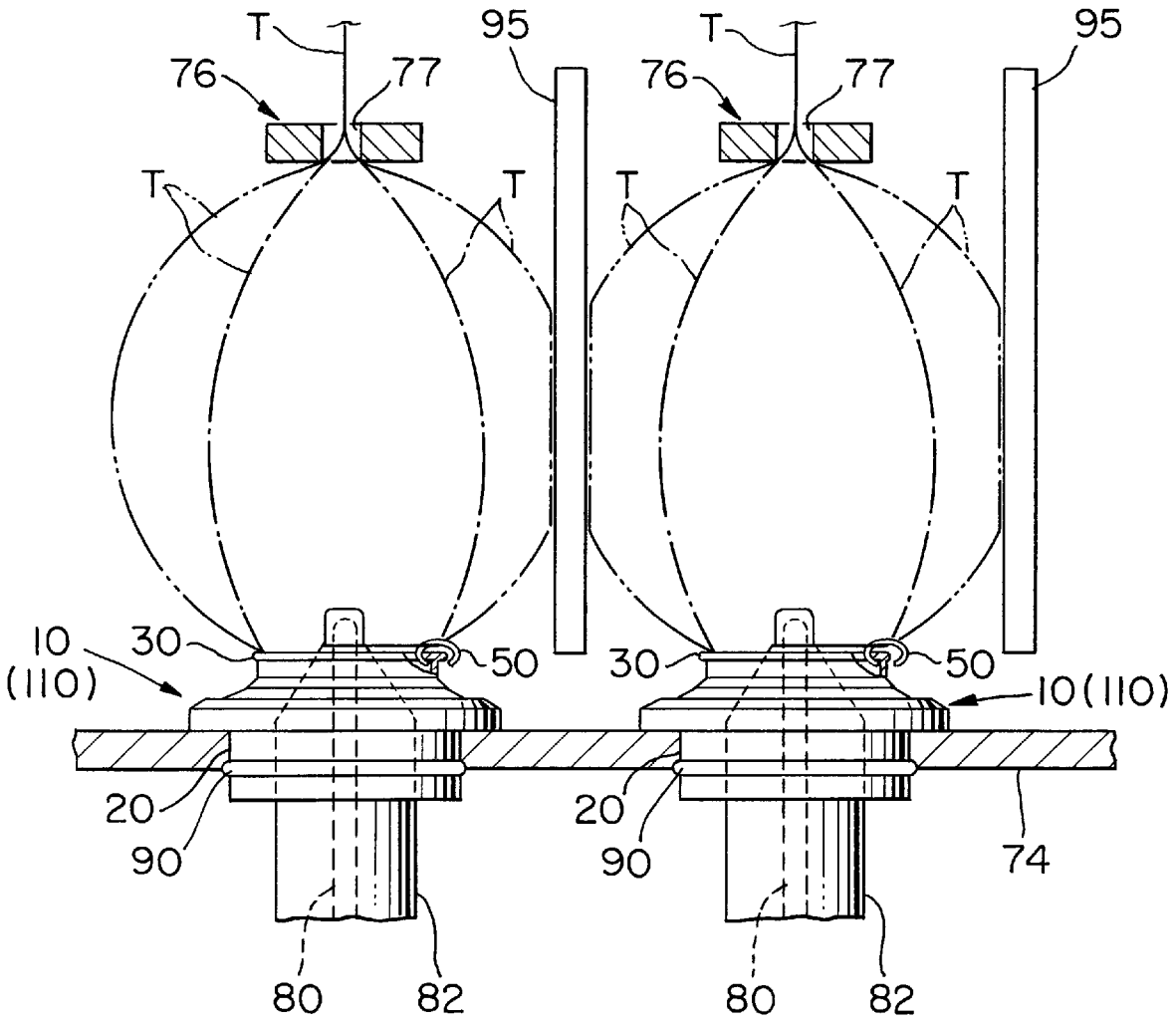
FIG. 7 is a fragmentary front view of the spinning frame, for assistance in explaining the variation of the diameter of a balloon of a yarn during a spinning operation.

Since the brake ring 60A of the spinning ring structure 10 is provided with the air pressure evading wall 64A facing the cop formed by winding the yarn $T_2$ on the bobbin 82, the radial vanes 68A of the brake ring 60A is not affected by whirling air currents produced by the rotating cop, and the brake ring 60A is not urged by the whirling currents in its rotating direction. Therefore, when the working circumferential speed of the cop starts decreasing when the spinning ring structure 10 starts rising from the height B toward the height A, the rotational speed of the rotary ring 30 and the revolving speed of the traveler 50 are decreased by a braking force of the brake ring 60A along an ideal speed reducing curve indicated by continuous lines in FIG. 6. Therefore, the deceleration of the rotary ring 30 and the traveler 50 is not retarded, a balloon indicated by long and short dash lines in FIG. 7 formed by the yarn $T_2$ will not expand and will not collapse, so that a spinning operation is smoothly carried out.

The brake ring 60A provided at its lower end with the screening flange 66A exercises the following effects. The radial vanes 68A do not stir the atmosphere and hence do not generate an excessively high braking force when the brake ring 60A rotates together with the rotary ring 30 because the radial vanes 68A are surrounded by the flange 62, the air pressure evading wall 64A, the lower screening flange 66A and the stationary ring 20 so as to be isolated from the space around the spinning ring structure 10. If the radial vanes 68A were not thus surrounded by the air pressure evading wall 64A and so on, the braking force of the brake ring 60A would increase progressively with the increase of the rotational speed of the same. Thus, the brake ring 60A included in the spinning ring structure 10 generates a necessary but not excessively high braking force. Accordingly, load on the spindle 80 is not increased excessively, and electrical energy for rotating the spindle 80 can be saved for energy conservation.

The gap 48A formed between the stationary ring 20 and the combination of the rotary ring 30 and the brake ring 60A, terminating at the lower surface of the sliding ring 40 and opening into a circumferential space around the spinning ring structure 10 exercises the following effect.

The sliding ring 40 is heated by frictional heat generated by friction between the rotary ring 30 and the sliding ring 40 and the temperature of the sliding ring 40 tends to rise. If heated at high temperature, the sliding ring 40 expands and its frictional resistance against the rotating rotary ring 30 increases to obstruct the rotation of the rotary ring 30. Since the gap 48A contiguous with the sliding ring 40 opens into the circumferential space surrounding the spinning ring structure 10, air in the gap 48A is urged to flow to the outside by centrifugal force as the rotary ring 30 rotates, while air is induced from above the sliding ring 40 through minute clearances existing between the ring 40 and the stationary and rotary rings 20 and 30 into the gap 48A, and consequently, heat generated in the sliding ring 40 can smoothly be dissipated, and the smooth rotation of the rotary ring 30 is ensured for smooth spinning operation. On the other hand, the rotation of the screening flange 66A causes air in the gap between the stationary ring 20 and the outer peripheral portion of the screening flange 66A to flow radially outward. This radially outward flow of air serves to prevent ingress of flies into the gap 48A adjacent the sliding ring 40, whereby smooth rotation of the rotary ring 30 can be maintained over a long period of time.

Second Embodiment

Figure 8:
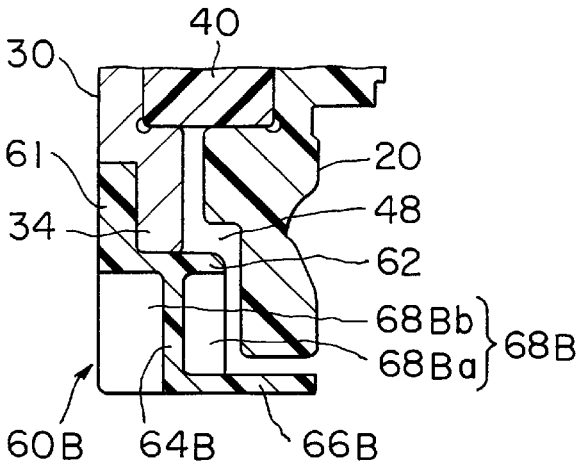
FIG. 8 is a fragmentary sectional view of a spinning ring structure in a second embodiment according to the present invention.

A spinning ring structure in a second embodiment according to the present invention is similar in construction to the spinning ring structure 10 in the first embodiment and hence only the difference of the second embodiment from the first embodiment will be described with reference to FIG. 8.

The spinning ring structure in the second embodiment includes a brake ring 60B provided with a fitting portion 61, an air pressure evading wall 64B of an inside diameter somewhat greater than that of the fitting portion 61, radial vanes 68B each divided into an outer portion 68B*a* and an inner portion 68B*b* by the air pressure evading wall 64B, and a lower screening flange 66B extending radially outward from the lower end of the air pressure evading wall 64B. Although the inner portions 68B*b* of the radial vanes 68B are exposed to the whirling air currents produced by the cop, the effect of the whirling air currents on the action of the brake ring 60B is not very significant and the collapse of the balloon formed by the yarn $T_2$ is avoided.

Third Embodiment

Figure 9:
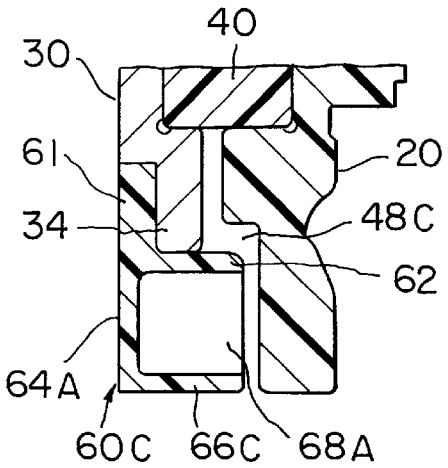
FIG. 9 is a fragmentary sectional view of a spinning ring structure in a third embodiment according to the present invention.

A spinning ring structure in a third embodiment according to the present invention is similar in construction to the spinning ring structure 10 in the first embodiment and hence only the difference of the third embodiment from the first embodiment will be described with reference to FIG. 9.

The spinning ring structure in the third embodiment includes a brake ring 60C provided with a flange 62, an air pressure evading wall 64A, radial vanes 68A, and a lower screening flange 66C extending radially outward from the lower end of the air pressure evading wall 64B to the outer edges of the radial vanes 68A, i.e., an imaginary cylindrical surface including the circumference of the flange 62. The lower screening flange 66C is on substantially the same level as that of the lower end of a stationary ring 20, and hence a gap 48C corresponding to the gap 48A of the spinning ring structure 10 in the first embodiment opens downward.

Fourth Embodiment

Figure 10:
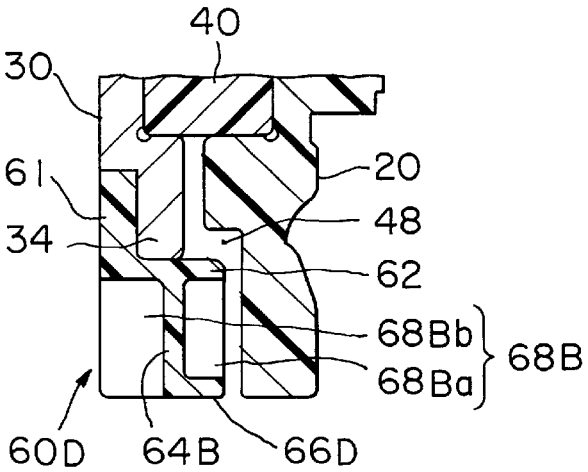
FIG. 10 is a fragmentary sectional view of a spinning ring structure in a fourth embodiment according to the present invention.

A spinning ring structure in a fourth embodiment according to the present invention is similar in construction to the spinning ring structure in the third embodiment and hence only the difference of the fourth embodiment from the third embodiment will be described with reference to FIG. 10.

The spinning ring structure in the fourth embodiment includes a brake ring 60D provided with a fitting portion 61, an air pressure evading wall 64B of an inside diameter somewhat greater than that of the fitting portion 61, radial vanes 68B each divided into an outer portion 68B*a* and an inner portion 68B*b* by the air pressure evading wall 64B, and a lower screening flange 66D extending radially outward from the lower end of the air pressure evading wall 64B.

Fifth Embodiment

Figure 11:
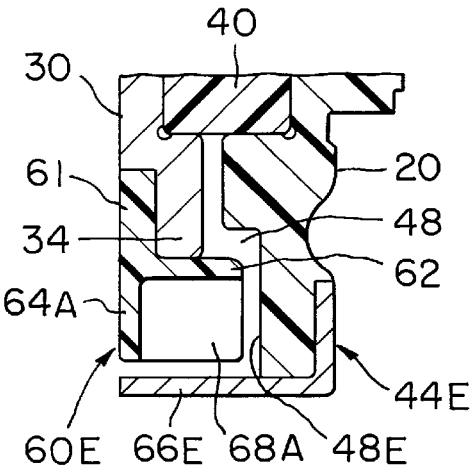
FIG. 11 is a fragmentary sectional view of a spinning ring structure in a fifth embodiment according to the present invention.

A spinning ring structure in a fifth embodiment according to the present invention is similar in construction to the spinning ring structure 10 in the first embodiment and hence only the difference of the fifth embodiment from the first embodiment will be described with reference to FIG. 11.

The spinning ring structure in the fifth embodiment includes a brake ring 60E similar to the brake ring 60A of the first embodiment, except that the brake ring 60E is not provided with any part corresponding to the lower screening flange 66A, and a lower screening member 44E attached to the lower portion of a stationary ring 20 and having a lower screening flange 66E extending radially inward from the lower end of the stationary ring 20 to an imaginary cylindrical surface including the inner surface of an air pressure evading wall 64A so as to underlie radial vanes 68A included in the brake ring 60E close to the lower edges of the radial vanes 68A.

The radial vanes 68A are thus surrounded by the flange 62, the air pressure evading wall 64A, the lower screening flange 66E and the stationary ring 20 and is substantially isolated from a space around the spinning ring structure. In this spinning ring structure, a gap 48E corresponding to the gap 48A in the spinning ring structure 10 in the first embodiment opens radially inward into a space surrounded by the spinning ring structure.

Sixth Embodiment

Figure 12:
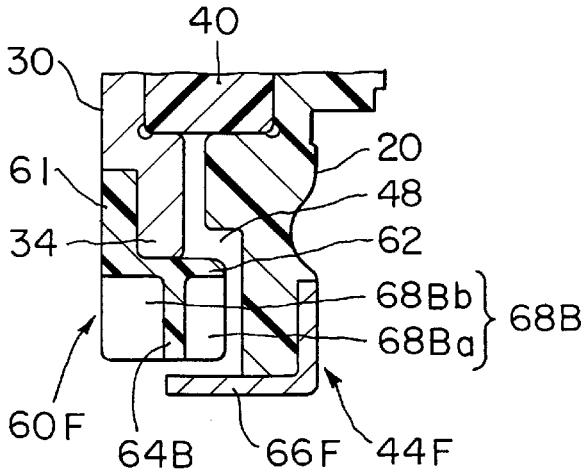
FIG. 12 is a fragmentary sectional view of a spinning ring structure in a sixth embodiment according to the present invention.

A spinning ring structure in a sixth embodiment according to the present invention is similar in construction to the spinning ring structure in the fifth embodiment and hence only the difference of the sixth embodiment from the fifth embodiment will be described with reference to FIG. 12.

The spinning ring structure in the sixth embodiment has a brake ring 60F provided with a fitting portion 61, and an air pressure evading wall 64B of a diameter somewhat greater than that of the fitting portion 61. A lower screening member 44F has a lower screening flange 66F extending radially inward from the lower end of a stationary ring 20 to an imaginary cylindrical surface including the inner circumference of the air pressure evading wall 64B.

Seventh Embodiment

A spinning ring structure in a seventh embodiment according to the present invention is similar in construction to the spinning ring structure 10 in the first embodiment and hence only the difference of the seventh embodiment from the first embodiment will be described with reference to FIG. 13.

The spinning ring structure in the seventh embodiment includes a brake ring 60G not provided with any parts corresponding to the air pressure evading wall 64A and the lower screening flange 66A of the spinning ring structure 10 in the first embodiment. A lower screening member 44G is attached to a lower portion of a stationary ring 20 and has a lower screening flange 66G and an air pressure evading wall 64G. The lower screening flange 66G extends close to the lower edges of radial vanes 68G from the lower end of a stationary ring 20 to an imaginary cylindrical plane at a short distance inward from an imaginary cylindrical plane including the inner edges of the radial vanes 68G. The air pressure evading wall 64G extends close to the inner edges of the radial vanes 68G from the inner end of the lower screening flange 66G upward substantially to a plane including the upper surface of a flange 62. The radial vans 68G are thus surrounded by the flange 62, the air pressure evading wall 64G, the lower screening flange 66G and the stationary ring 20. A gap 48G corresponding to the gap 48A of the first embodiment opens upward.

Figure 13:
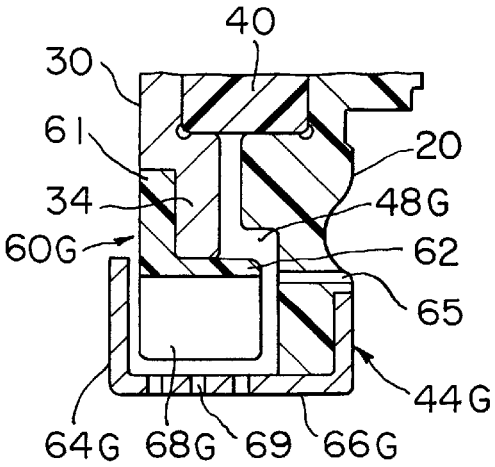
FIG. 13 is a fragmentary sectional view of a spinning ring structure in a seventh embodiment according to the present invention.
Figure 14:
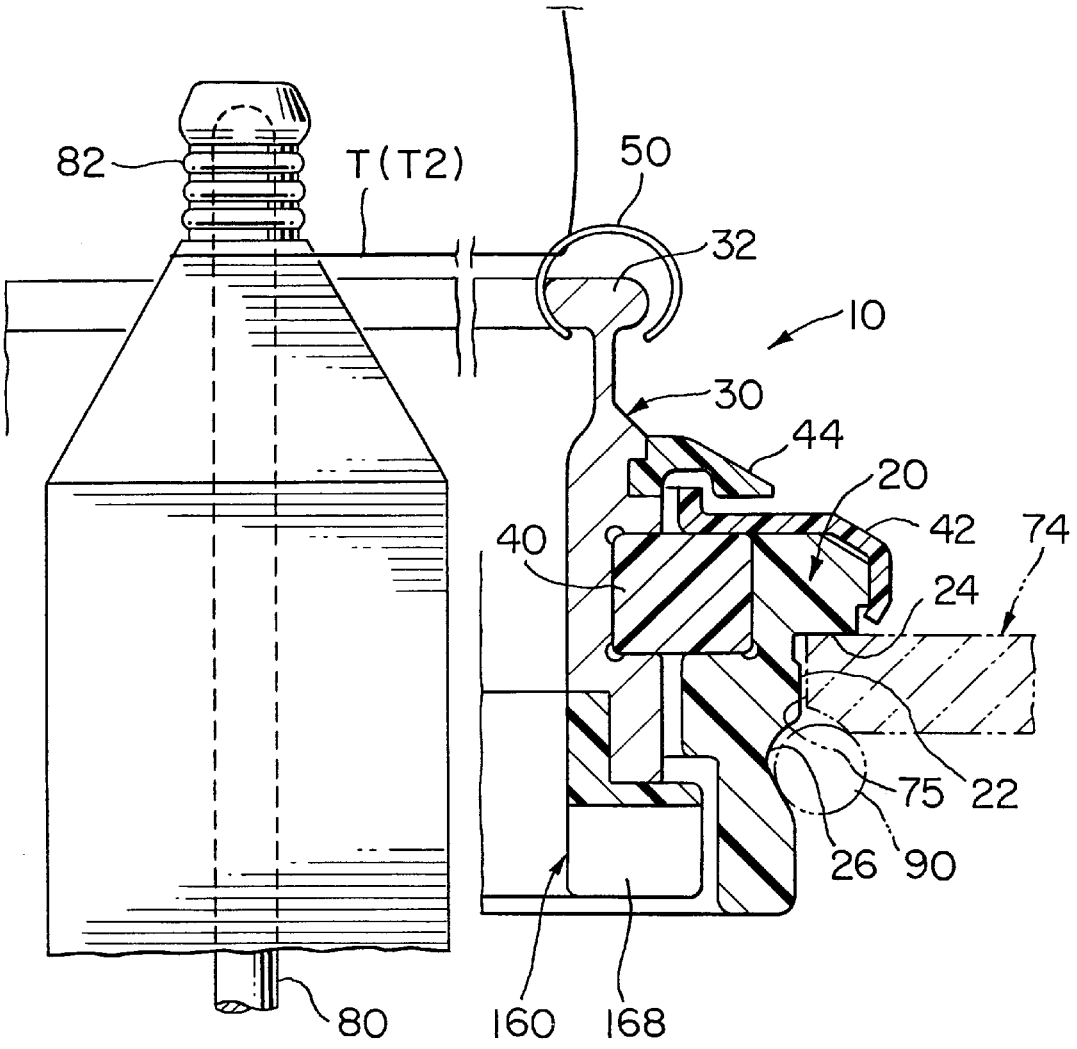
FIG. 14 (PRIOR ART)
FIG. 14 is a sectional view of a conventional spinning ring structure.
Figure 15:
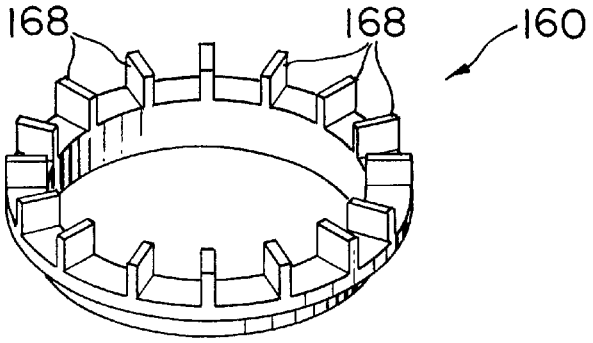
FIG. 15 (PRIOR ART)
FIG. 15 is a perspective view of a brake ring included in the spinning ring structure of FIG. 14, in an inverted position.

In the embodiments shown in FIGS. 9 to 13, the stationary rings 20 respectively surrounding the brake rings 60C, 60D, 60E, 60F and 60G, and the lower screening flanges 66E, 66F and 66G may be provided with air holes 65 and 69 for heat dissipation as shown in FIG. 13. The brake rings may be provided with a plurality of ridges instead of the radial vanes.

Although the invention has been described in its preferred forms with a certain degree of particularity, obviously many changes and variations are possible therein. It is therefore to be understood that the invention may be practiced otherwise than as specifically described herein without departing from the scope and spirit thereof.

What is claimed is:

1. A spinning ring structure of a spinning frame for twisting a fleece produced by drafting a roving supplied from a roving feed means into a yarn and taking up the yarn on a bobbin, said spinning ring structure comprising:

a stationary ring fixedly mounted on a ring rail and coaxially relative to the bobbin;

a rotary ring disposed for rotation about an axis thereof inside the stationary ring coaxially therewith and surrounding the bobbin;

a traveler mounted on the rotary ring for revolving motion along s circumference of the rotary ring to guide the yarn toward a cop formed by winding the yard on the bobbin;

a brake member mounted coaxially on the rotary ring and provided with a brake ring having a plurality of radial vanes fixed thereto for producing aerodynamic resistance against turning of the brake member and thereby effecting a braking motion which is caused primarily by the aerodynamic resistance produced by the radial vanes; and an air pressure evading wall for preventing whirling air currents produced by the rotating cop from influencing the braking motion of the radial vanes, said air pressure evading wall isolating at least portions of the radial vanes from a space surrounding the cop.

2. The spinning ring structure according to claim 1, wherein said air pressure evading wall is formed integrally with the brake ring.

3. The spinning ring structure according to claim 1, wherein the vanes are concealed to a space around an upper portion of the spinning ring structure.

4. The spinning ring structure according to claim 1, wherein the vanes are substantially screened from the ambience.

5. The spinning ring structure according to claim 1, wherein the vanes of the brake ring lie under the rotary ring, and a lower screening wall extends from the stationary ring to cover the vanes from below.

6. The spinning ring structure according to claim 5, wherein said lower screening wall is integral with said air pressure evading wall.

7. The spinning ring structure according to claim 1, wherein a sliding ring is provided between the stationary ring and the rotary ring, and a downwardly extending heat dissipation gap is formed immediately below the sliding ring and between the stationary ring and the rotary ring.

8. The spinning ring structure according to claim 7, wherein said stationary ring has heat dissipation holes communicating with the gap.

9. The spinning ring structure according to claim 7, further comprising a lower screening wall positioned below said brake member to cover the same, said screening wall having heat dissipation holes communicating with said gap.

10. A spinning ring structure of a spinning frame for twisting a fleece produced by drafting a roving supplied from a roving feed means into a yarn and taking up the yarn on a bobbin, said spinning ring structure comprising:

a stationary ring fixedly mounted on a ring rail and coaxially relative to the bobbin;

a rotary ring disposed for rotation about an axis thereof inside the stationary ring coaxially therewith and surrounding the bobbin;

a traveler mounted on the rotary ring for revolving motion along s circumference of the rotary ring to guide the yarn toward a cop formed by winding the yard on the bobbin;

a brake member mounted coaxially on the rotary ring and provided with a brake ring having a plurality of radial vanes for producing aerodynamic resistance against turning of the brake member, the vanes of the brake ring being disposed under the rotary ring and having lowers ends which are covered with a lower screening wall; and an air pressure evading wall for preventing whirling air currents produced by the rotating cop from influencing a braking motion of the radial vanes, said air pressure evading wall isolating at least portions of the radial vanes from a space surrounding the cop.

11. The spinning ring structure according to claim 10, wherein said screening wall extends away from said axis of the rotary ring to a region under said stationary ring to form an air gap between the screening wall and the stationary ring.

12. A spinning ring structure of a spinning frame for twisting a fleece produced by drafting a roving supplied from a roving feed means into a yarn and taking up the yarn on a bobbin, said spinning ring structure comprising:

a stationary ring fixedly mounted on a ring rail and coaxially relative to the bobbin;

a rotary ring disposed for rotation about an axis thereof inside the stationary ring coaxially therewith and surrounding the bobbin;

a traveler mounted on the rotary ring for revolving motion along s circumference of the rotary ring to guide the yarn toward a cop formed by winding the yard on the bobbin;

a brake member mounted coaxially on the rotary ring and provided with a brake ring having a plurality of radial vanes for producing aerodynamic resistance against turning of the brake member; and an air pressure evading wall for preventing whirling air currents produced by the rotating cop from influencing a braking motion of the radial vanes, said air pressure evading wall being attached to said stationary ring and isolating at least portions of the radial vanes from a space surrounding the cop.

13. A spinning ring structure for use with a spinning frame which winds material forming a cop comprising:

a rotary ring disposed for rotation about an axis thereof;

a brake member mounted on the rotary ring for rotation with the rotary ring, the brake member having at least one vane located thereon, which primarily caused aerodynamic resistance against turning of the brake member; and an air pressure evading wall for shielding the at least one vane from whirling air currents produced by the cop during rotation of the cop.

14. The spinning ring structure as claimed in claim 13, wherein the air pressure evading wall is located on the brake member.

15. The spinning ring structure as claimed in claim 13, wherein the air pressure evading wall is secured in a stationary position adjacent to the brake member.

16. The spinning ring structure as claimed in claim 13, wherein the at least one vane is substantially screened from ambient air.

17. A spinning ring structure for use with a spinning frame which winds material forming a cop comprising:

a rotary ring disposed for rotation about an axis thereof;

a brake member mounted on the rotary ring for rotation thereon for producing aerodynamic resistance against turning of the brake member, the brake member having at least one vane located thereon for producing aerodynamic resistance against turning of the brake member; and an air pressure evading wall for shielding the at least one vane from the air pressure currents produced by the cop during rotation of the cop, the at least one vane of the brake member lying under the rotary ring and having a lower end covered with a lower screening wall.

18. The spinning ring structure as claimed in claim 17, further comprising a stationary ring secured in a concentric position around the rotary ring.

19. The spinning ring structure as claimed in claim 18, wherein the screening wall extends away from the axis of the rotary ring to a region under the stationary ring to form an air gap between the screening wall and the stationary ring.

20. The spinning ring structure as claimed in claim 18, wherein the air pressure evading wall is attached to the stationary ring.

* * * * *